US009180942B2

(12) United States Patent
Duff et al.

(10) Patent No.: US 9,180,942 B2
(45) **Date of Patent: *Nov. 10, 2015**

(54) MULTIFUNCTIONAL ENGAGEMENT APPARATUS FOR A WATER RECREATION DEVICE AND ASSOCIATED METHODS

(75) Inventors: Glen Wade Duff, Williamsburg, VA (US); John Martin, Vashon, WA (US)

(73) Assignee: ZUP LLC, Williamsburg, VA (US)

( * ) Notice: Subject to any disclaimer, the term of this patent is extended or adjusted under 35 U.S.C. 154(b) by 163 days.

This patent is subject to a terminal disclaimer.

(21) Appl. No.: 13/603,579

(22) Filed: Sep. 5, 2012

(65) Prior Publication Data

US 2012/0329348 A1 Dec. 27, 2012

Related U.S. Application Data

(63) Continuation-in-part of application No. 12/592,759, filed on Dec. 2, 2009, now Pat. No. 8,292,681.

(60) Provisional application No. 61/200,637, filed on Dec. 2, 2008.

(51) Int. Cl.
*B63B 35/79* (2006.01)

(52) U.S. Cl.
CPC ..... *B63B 35/7936* (2013.01)

(58) Field of Classification Search
CPC ..... B63B 35/7936
USPC ..... 441/65, 74, 75
See application file for complete search history.

(56) References Cited

U.S. PATENT DOCUMENTS 3,092,068 A 6/1963 Brownson
3,219,007 A 11/1965 Kiefer
3,304,904 A 2/1967 Spurlock
3,918,114 A 11/1975 Schmitt
4,069,786 A 1/1978 La Botz
4,392,833 A 7/1983 Hayden
4,592,734 A 6/1986 Metiver
4,678,444 A 7/1987 Monreal
4,867,722 A 9/1989 Joseph
4,989,531 A 2/1991 Humphrey
5,083,955 A 1/1992 Echols
5,163,860 A 11/1992 Clark
5,167,553 A 12/1992 Wilson
5,427,047 A 6/1995 Woodfin et al.
5,447,116 A 9/1995 Kobayashi
5,634,834 A 6/1997 Cole et al.
5,797,779 A 8/1998 Stewart
5,820,430 A 10/1998 Hornsby et al.
6,007,394 A 12/1999 Kagan
6,585,549 B1 7/2003 Fryar
7,216,600 B1 5/2007 Hamilton et al.
8,292,681 B2 * 10/2012 Duff et al. ..... 441/65

OTHER PUBLICATIONS

U.S. Appl. No. 13/603,530, filed Sep. 5, 2012, Duff.

* cited by examiner

*Primary Examiner* — Edwin Swinehart
(74) *Attorney, Agent, or Firm* — Berenato & White, LLC

(57) ABSTRACT

A multifunction engagement apparatus for use with a water recreation device may include a foot pad and a multifunction strap. The multifunction strap may be positioned to overlie the substantially flat foot pad, and may be moveable between an uncollapsed position and a collapsed position. In the uncollapsed position, the multifunction strap may present a generally arcuate foot opening between the strap and the top surface of the foot pad. In the collapsed position, the multifunction strap may present a substantially flat contact cushion atop the foot pad. The multifunction strap may have elastic properties that allow for selective positioning of the multifunction engagement member for use by a towed rider as the rider transitions between prone, kneeling, and/or standing positions atop a water recreation device.

20 Claims, 8 Drawing Sheets

MULTIFUNCTIONAL ENGAGEMENT APPARATUS FOR A WATER RECREATION DEVICE AND ASSOCIATED METHODS

RELATED APPLICATIONS

This application is a continuation in part of U.S. patent application Ser. No. 12/592,759 titled Water Recreation Device filed on Dec. 2, 2009, which, in turn, claims the benefit of U.S. Provisional Patent Application No. 61/200,637 filed on Dec. 2, 2008, the entire contents of each of which are incorporated herein by reference. This application is also related U.S. patent application Ser. No. 13/603,530 titled Tow Rope System and Associated Methods, filed simultaneously herewith, the entire contents of which are also incorporated herein by reference.

FIELD OF THE INVENTION

The present invention relates generally to the field of water recreation devices and particularly to devices and methods for engagement of a water recreation device by a rider.

BACKGROUND OF THE INVENTION

Water sports, such as wake boarding, commonly require use of a foot binding system to engage a rider with a water recreation device as the device is pulled along the surface of the water behind a powerboat. Conventional foot binding systems typically include a foot securing means attached to the top surface of a water recreation device. Common foot securing means range from simple strap solutions to complex booting systems.

However, current foot binding systems can be difficult for a rider (particularly a novice rider) to effectively use. For example, a typical foot binding system requires the rider to engage the bindings prior to the start of a ride, and to maintain that contact with the foot bindings while the water recreation device is in motion. Such a design prevents the rider from starting a ride from a more stable position (for example, a prone position) atop the water recreation device, and subsequently transitioning to a position that involves engaging the foot binding system only after the device has achieved planing upon the surface of the water.

Consequently, many potential water recreation device riders who possess lesser physical ability are precluded from using conventional foot binding systems as designed. Furthermore, the obtrusive presence of typical foot binding systems upon the surface of a water recreation device precludes riders from using those systems in ways other than designed (for example, assuming a prone position by lying atop the foot bindings). Simply put, the foot bindings get in the way and, therefore, prevent alternate use of the water recreation device.

Several foot binding systems that feature a low profile exist for use by a rider of a water recreation device. For example, a foot strap that flexes and collapses to permit a rider to lie flat on a water recreation device is disclosed in U.S. Pat. No. 4,592,734 to Metiver (hereinafter "Metiver"). However, the baseplates described in the Metiver reference protrude upward from the surface of the water recreation device, presenting uncomfortable contact points for elbows, knees, and other parts of a rider's body that may come into contact with the baseplates. Furthermore, the straps disclosed in the Metiver reference do nothing to cushion contact made by a rider with the outer surface of the straps. Instead, the focus of comfort features in the Metiver reference is limited to the inner surfaces of the straps, which are those surfaces that come into contact with the rider's feet.

Retractable foot binding systems attempt to help a rider maintain comfort while lying in a prone position atop a water recreation device. U.S. Pat. No. 6,007,394 to Kagan (hereinafter "Kagan") describes a surfboard foot binding device that is retractable into a recessed cavity in the deck of a surfboard. When in an upward position, a pivotal member of the device creates an inclined plane under which a surfer may position his foot. When in a downward position, the top of the retracted pivotal member of the device creates a relatively flat surface upon which the rider may lie prone comfortably. However, the hardware components left exposed when the Kagan device is in a retracted position, such as hinges, elastic straps, and looped strips, present obstacles atop the water recreation device that may compromise not only rider comfort but also rider safety. Furthermore, the retracted Kagan device does not provide a contact cushion designed for the rider's comfort when he comes into physical contact with the retracted binding device. Also, the Kagan device may present a pinching hazard when retracting.

Collapsible foot binding systems are also designed to provide comfort to a rider lying in a prone position atop a water recreation device. U.S. Pat. No. 5,167,553 to Wilson (hereinafter "Wilson") describes a surfboard foot strap system that is collapsible into a recess in a surrounding base. The Wilson system employs inner and outer pads layered on a flat, curved reinforcement member that is made of a resilient, semi-rigid material to give the pads an arched shape as a foot opening. The foot strap system may be substantially flattened by application of downward pressure. However, like the Kagan foot binding system, the Wilson solution does not provide a contact cushion for the rider's comfort when he comes into physical contact with the collapsed device. Also, like the Kagan system, the necessary rigidity of certain components of the Wilson foot binding system may present a pinching hazard when in the downward position.

SUMMARY OF THE INVENTION

With the above in mind, the present invention advantageously provides a multifunction engagement apparatus that facilitates selective use of the apparatus as a foot binding or as a contact cushion during towing of a rider on a water recreation device. The present invention further advantageously provides methods by which a multifunction engagement apparatus may be selectively positioned for use by a rider of a water recreation device while the rider transitions between prone, kneeling, and/or standing positions. The present invention also advantageously provides a water recreation device that includes the engagement apparatus that allows for multifunctional use thereof.

These and other objects, features, and advantages according to the present invention are provided by a multifunctional engagement apparatus that may comprise a foot pad and a multifunctional strap. The foot pad may be substantially flat, may have a top surface and a bottom surface, and may have an outer peripheral portion that may have an arcuate shape. For example, and without limitation, an outer peripheral portion of a foot pad may have an hourglass shape or an elliptical shape. The multifunction strap may have a first end and a second opposing end.

The multifunction strap may project outwardly from its ends in relation to the top surface of the foot pad, and may be moveable between an uncollapsed position and a collapsed position. The uncollapsed position may be defined as a multifunction strap being positioned to create a foot opening within a generally arcuate shape. The collapsed position may be defined as a multifunction strap being substantially flattened in relation to the top surface of a foot pad to create a contact cushion.

The multifunction engagement apparatus may be made of one or more elastomeric materials. For example, and without limitation, either or both of the foot pad and the multifunctional strap may be made of neoprene, plastic, rubber, and/or polyurethane. The multifunction strap may have an inner cover coupled with an outer cover, both covers being substantially smooth. The multifunction strap may have at least one layer of padding between an inner cover and an outer cover. The multifunction strap may have a lace system layered between an inner cover and an outer cover. The multifunction strap may have a pocket opening positioned between an inner cover and an outer cover to create a passageway to a lace system. The outer cover may be releasable from either or both of a first and a second end of the multifunction strap to selectively cover or expose a lace system.

The first and the second end of the multifunction strap may be fixedly attached to the foot pad and/or to the surface of a water recreation device using fasteners such as adhesives, screws, and nuts and bolts. A receiving groove may be fixedly attached to the foot pad, and the first and the second end of a multifunction strap may be adjustably attached to a receiving groove using fasteners such as a threaded bolt, a mounting clip, and a set screw. Either or both of the first and second ends of the multifunction strap may be releasably attached to the foot pad using a hook-and-loop fastener.

The water recreation device that may make use of a multifunction engagement apparatus may have a top surface, a bottom surface, a bow, a stern, a port, and a starboard. The water recreation device may have one or more handles disposed on the top surface of the water recreation device aft of the bow. The first and second multifunction engagement apparatus may be disposed side-by-side on the top surface of the water recreation device aft of the one or more handles to support simultaneous engagement by a rider. Simultaneous engagement of the rider with the one or more handles and with the multifunction engagement apparatus may position the rider in a prone, kneeling, or crouching position facing the bow of the riding board.

A method aspect of the present invention is for a rider of a water recreation device to make use of a multifunctional engagement apparatus as the device is being towed along the surface of a body of water. The method may include attaching a tow rope to a tow hook mounted on a water recreation device. The method may include the other end of the tow rope being connected to a water vehicle. The method may include a rider grasping the one or more handles of the water recreation device.

The method may include a rider achieving a prone position atop a water recreation device by positioning the first and second elbows of the rider to rest atop the first and second multifunction straps, respectively. The method may include a rider applying force with his elbows to collapse each of the multifunction straps to its substantially flattened configuration in relation to the surface of the riding board. The method may include a rider maintaining a prone start position until the riding board has achieved a substantially parallel position relative to the surface of the water.

The method may include a rider achieving a kneeling position by placing both knees on the top surface of the riding board. The method may also include a rider lifting his elbows from atop the first and second multifunction straps, thereby allowing multifunction straps to uncollapse due to elasticity. The method may further include a rider positioning the first and second knees of the rider to rest atop the first and second multifunction straps, respectively. The method may still further include a rider collapsing each of the multifunction straps to its substantially flattened configuration in relation to the surface of the riding board.

The method may also include a rider achieving a standing position by placing a first foot into the first engagement member and then placing a second foot into the second engagement member. The method may further include a rider lifting the first and second knees of the rider from atop the first and second multifunction straps, respectively. The method may also include a rider waiting for each of the first and second multifunction straps to resume its substantially arcuate configuration in relation to the surface of the riding board. The method may still further include a rider placing a first foot into the first engagement member and placing a second foot into the second engagement member.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring now to FIGS. 1-5, a multifunction engagement apparatus 110 according to the present invention is now described in greater detail. The multifunction engagement apparatus 110, according to an embodiment of the present invention, advantageously may be selectively positioned for use by a towed rider of a water recreation device while the rider transitions between prone, kneeling, and/or standing positions. The multifunction engagement apparatus 110 may operate either as a foot binding or as a contact cushion, depending on the preference of a rider.

Figure 1A:
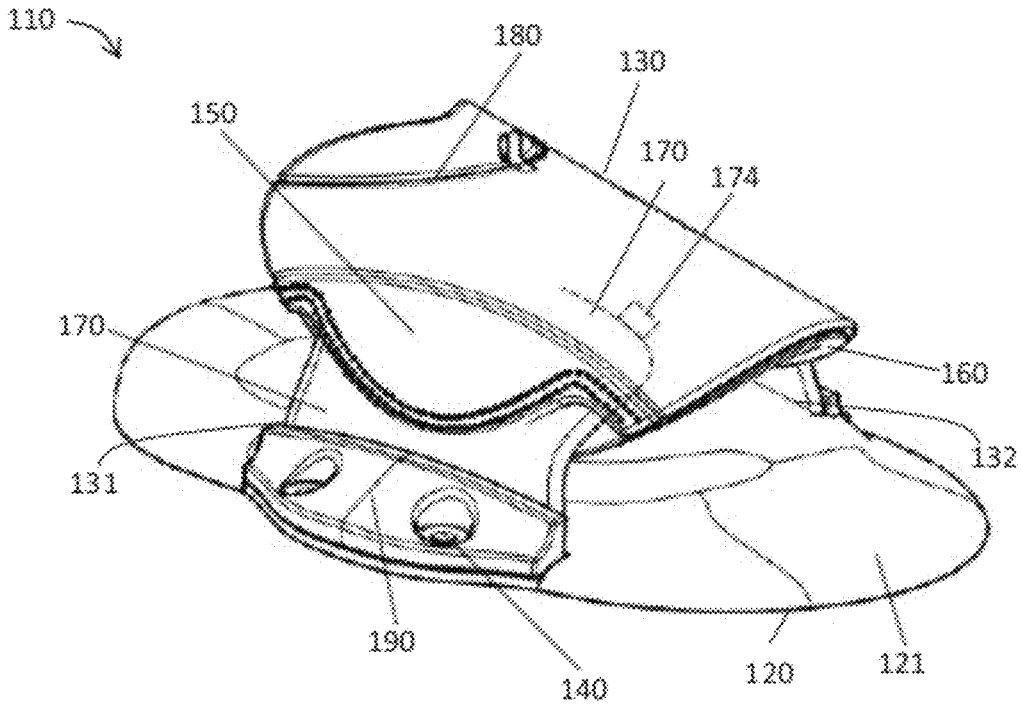
FIG. 1A is a top perspective view of a multifunction engagement apparatus in an uncollapsed position according to an embodiment of the present invention.

As shown in the embodiment of FIG. 1A, the multifunction engagement apparatus 110 may include a foot pad 120 and a multifunction strap 130. As discussed in greater detail below, the foot pad 120 and multifunction strap 130 may be provided in several different shapes and configurations to achieve the objects, goals, features and advantages of the present invention.

For example, and without limitation, the foot pad 120 may be substantially flat, and may have a top surface 121 and a bottom surface 123. The bottom surface 123 of a foot pad 120 may be shaped to engage the top surface of a water recreation device, to be described in greater detail below. The top surface 121 of the foot pad 120 may be contoured to receive a foot. For example, and without limitation, the foot pad 120 may present a cup nearer the rear of the foot pad 120 to receive the heel of a foot, and may present a jam nearer the front of the foot pad 120 to engage the ball of a foot. The foot pad 120 may have an outer peripheral portion that defines an arcuate shape. For example, and without limitation, the foot pad 120 may be generally shaped like an hourglass shape or, alternatively, like an ellipse.

Continuing to refer to FIG. 1A, a multifunction strap 130 may have a first end 131 and a second opposing end 132 disposed adjacent to opposite sides of a foot pad 120. A multifunction strap 130 may project upwardly in relation to the top surface 121 of the foot pad 120 to form a shape that may receive a foot. A multifunction strap 130 may be constructed with elastic material that may allow the whole strap 130 to collapse in a substantially flat, or slightly concave, manner against the top surface 121 of a foot pad 120 when depressed by force from a rider's body. Use of elastic materials may provide a multifunction strap 130 the ability to recover to its original upward-projecting shape when a rider removes the force that depressed the strap 130.

Figure 3:
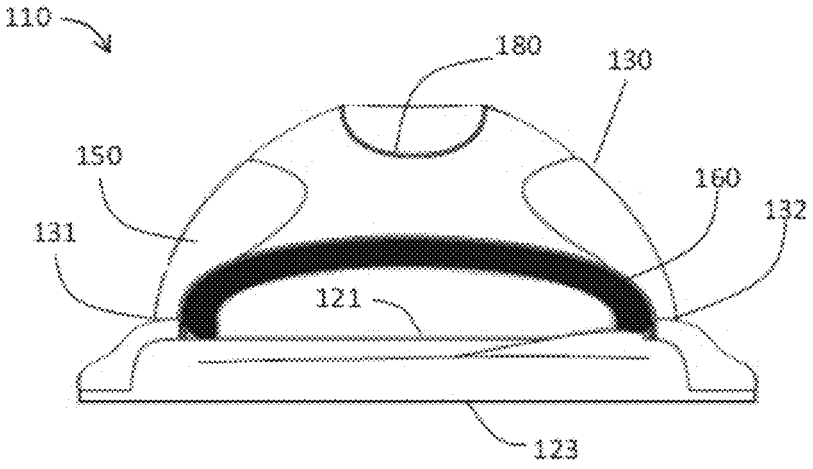
FIG. 3 is a front elevation view of the multifunction engagement apparatus illustrated in FIG. 2.

Referring now to FIGS. 1A and 3, a multifunction strap 130 may comprise an outer cover 150 and an inner cover 160. Because both the outer and inner covers 150, 160 may be designed to come into contact with the skin of a water recreation device rider, both covers 150, 160 may be substantially smooth to provide for a rider's comfort. An inner cover 160 may present a soft and durable surface designed to receive a rider's foot. An outer cover 150 may present a soft and durable surface designed as a contact cushion for the knees, elbows, and other parts of a rider's body.

Figure 4:
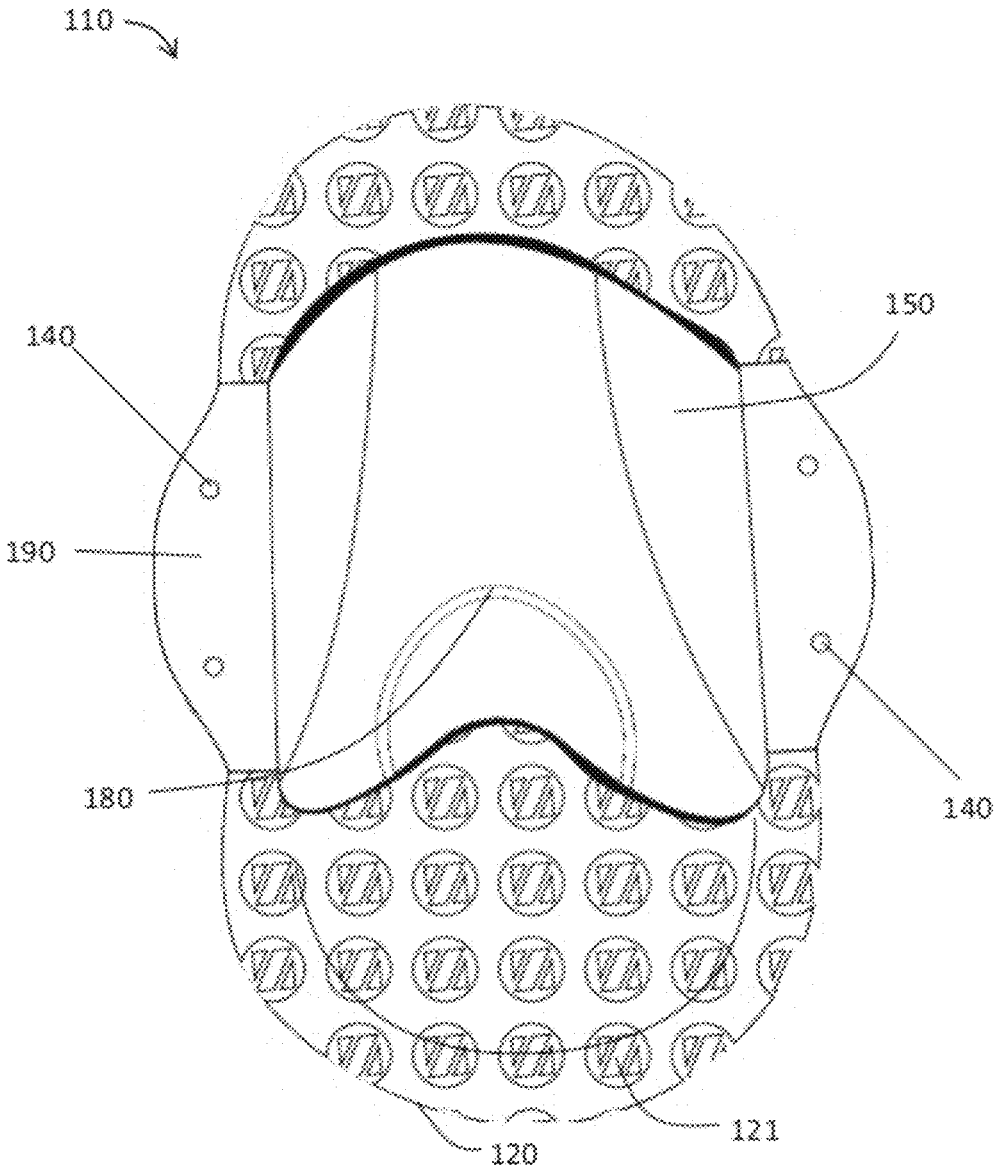
FIG. 4 is a top plan view of the multifunction engagement apparatus illustrated in FIG. 2.

Both a foot pad 120 and a multifunction strap 130 may be made of one or more elastomeric materials to take advantage of the characteristics of elastomers such as strength, elasticity, and water-resistance. For example, and without limitation, a foot pad 120 may be constructed of any combination of neoprene, plastic, rubber, and/or polyurethane. Similarly for example, and without limitation, a multifunction strap 120 may be constructed of any combination of neoprene, plastic, rubber, and/or polyurethane. As shown in FIG. 4, a top surface 121 of a foot pad 120 may be textured to prevent slipping.

Figure 1B:
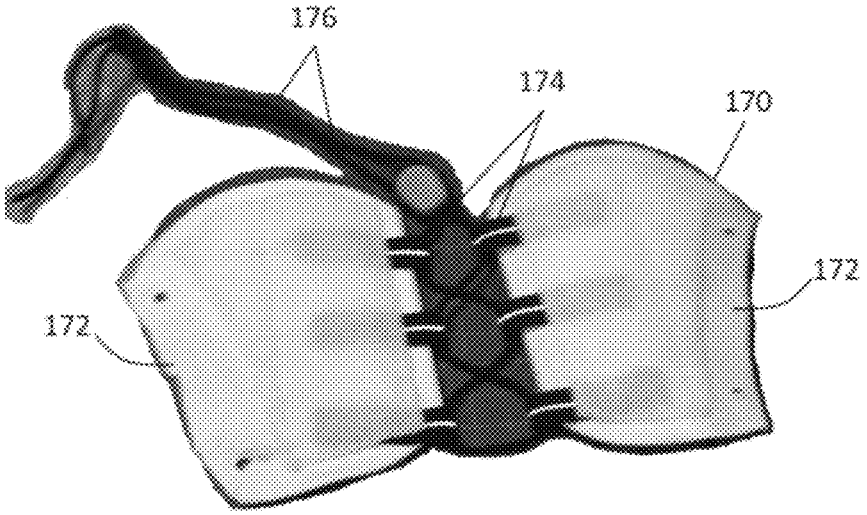
FIG. 1B is a top perspective view of a lace system for use in a multifunction engagement apparatus according to an embodiment of the present invention.
Figure 2:
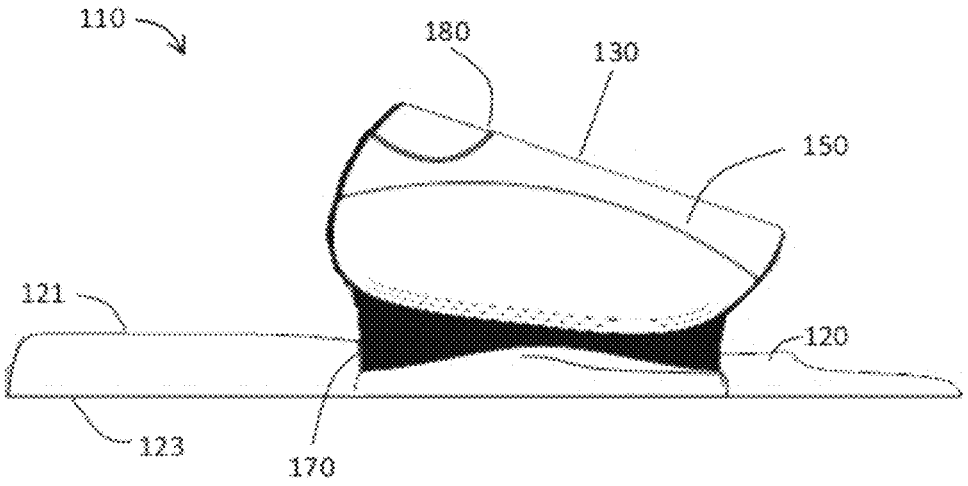
FIG. 2 is a right side elevation view of the multifunction engagement apparatus illustrated in FIG. 1A.

Continuing to refer to FIG. 1A and additionally referring to FIG. 1B, the multifunction strap 130 may include a lace system 170 layered between an outer cover 150 and an inner cover 160. For example, the lace system 170 may comprise an open-laced vamp design, the sides 172 of which may extend to the connected first and second ends 131, 132 of the multifunction strap 130, and the lace-up eyestays 174 of which may be stowed internal to the multifunction strap 130. In an alternative embodiment, the multifunction engagement apparatus 110 may comprise one or more layers of padding (not shown) inserted between the lace system 170 and either of the outer or inner covers 150, 160.

As further illustrated in FIGS. 1A, 2, 3, and 4, a pocket opening 180 may be positioned between an inner cover 160 and an outer cover 150 to present a passageway through which a rider may access a lace system 170. For example, and without limitation, a pocket opening 180 may provide an access system on the multifunction strap 130 from which a rider may pull out lace cords 176 from the lace system 170, adjust the laces 176 as desired, and then secure the lace cords 176 back between the outer and inner covers 150, 160. Such a design may ensure that only the outer and inner covers 150, 160 of a multifunction engagement apparatus 110 may contact the body of a rider while he is riding a water recreation device, yet may allow for quick and easy access to a lace system 170 so that the rider may make size, comfort, and performance adjustments. In another embodiment, for example and without limitation, an outer cover 150 may be releasable from either or both of a first end 131 and a second end 132 of a multifunction strap 130 to selectively cover or expose a lace system 170.

Referring now to FIGS. 1A and 4, the first and second ends 131, 132 of a multifunction strap 130 may be connected adjacent to the outer peripheral portion of a foot pad 120 by fasteners 140. For example, and without limitation, fasteners 140 may include one or more of adhesives, screws, and nuts and bolts. A multifunction strap 130 may be attached using fasteners 140 either to a foot pad 120 or, alternatively, to the top surface of a water recreation device. In another embodiment, a receiving groove 190 may be fixedly attached to a foot pad 120, and a first end 131 and a second end 132 of a multifunction strap 130 may be adjustably attached to a receiving groove 190 using adjustable fasteners. For example, and without limitation, such adjustable fasteners may include a threaded bolt, a mounting clip, and a set screw.

In yet another embodiment, either or both of a first end 131 and second end 132 of a multifunction strap 130 may be releasably attached to a foot pad 120 or to a top surface of a water recreation device using a hook-and-loop fastener (not shown). Such a design not only may allow the outer cover 150 to release to expose a lacing system 170 underneath, but also may allow a rider to make unique adjustments of the pitch of the multifunction strap 130 in relation to a rider's foot. For example, and without limitation, the angle of the multifunction strap 130 from a toe-to-heel direction may be adjusted, along with the spread of a lacing system 170, to allow for one or more of the following: 1) different instep fitting, 2) easy access to the multifunction strap when the foot is tilted upwards during insertion, 3) different lacing positions, angles, and fit. A design that employs a hook-and-loop fastener may also act as a quick release, allowing for quick parts replacement (e.g., foot pad 120, lace system 170, covers 150, 160).

Figure 5:
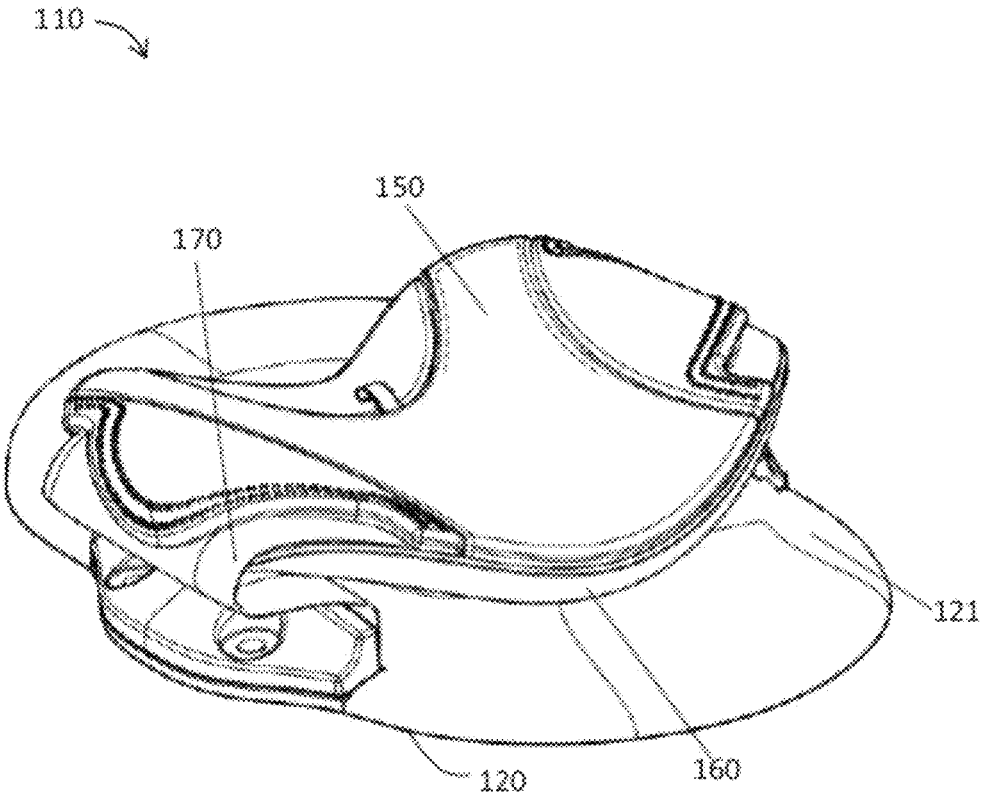
FIG. 5 is a top perspective view of the multifunction engagement apparatus illustrated in FIG. 1A.

Referring now to FIGS. 1A and 5, a multifunction strap 130 may be moveable between an uncollapsed position and a collapsed position. As illustrated in FIG. 1A, an uncollapsed position may be defined as a multifunction strap 130 being positioned to create a foot opening within a generally arcuate shape. A multifunction strap 130 may be constructed such that its elastic properties establish its natural state to be uncollapsed. As illustrated in FIG. 5, a collapsed position may be defined as a multifunction strap 130 being substantially flattened in relation to the top surface 121 of a foot pad 120 to create a contact cushion. Because the elastic properties of a multifunction strap 130 may cause the strap 130 to resist a change from its natural uncollapsed state, downward force may be applied to an outer cover 150 to cause a multifunction strap 130 to take on a collapsed state.

Figure 6:
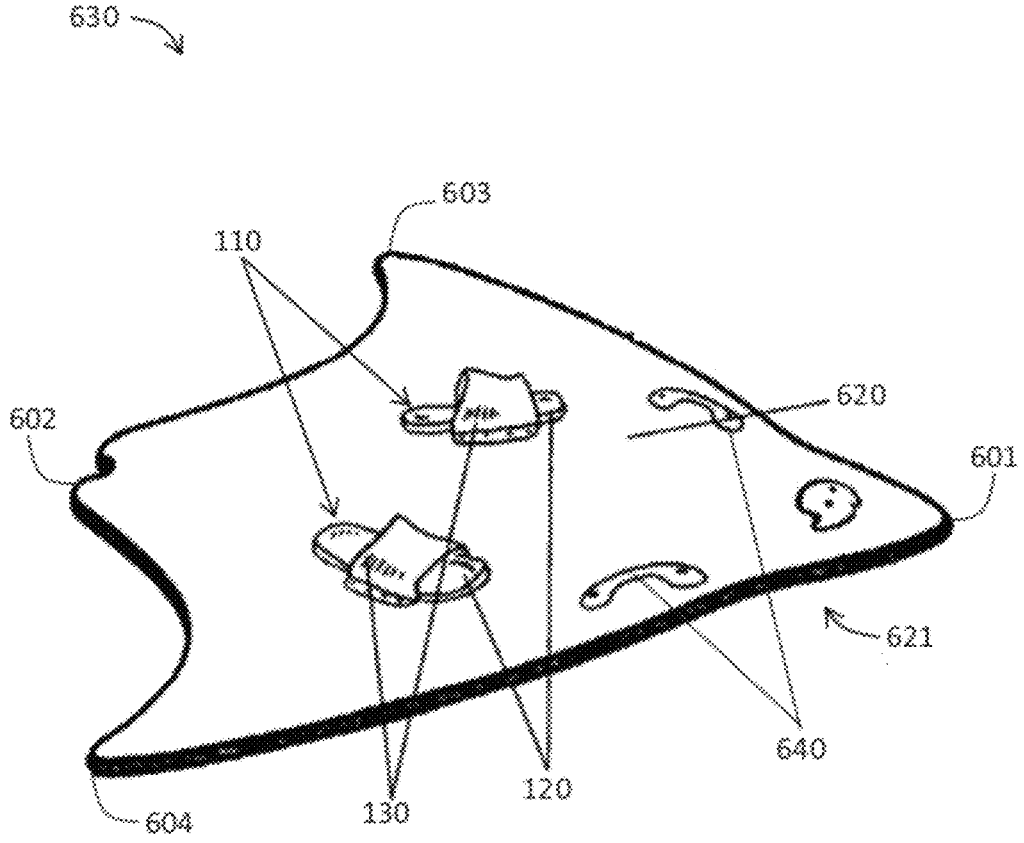
FIG. 6 is a perspective view of an exemplary water recreation device configured with a multifunction engagement apparatus according to an embodiment of the present invention connected thereto.

As shown in the embodiment of FIG. 6, a water recreation device 630 that may make use of a multifunction engagement apparatus may have a top surface 620, a bottom surface 621, a bow 601, a stern 602, a port 603, and a starboard 604. A water recreation device 630 may have one or more handles 640 disposed on the top surface 620 of the water recreation device 630 aft of the bow 601. A first and second engagement apparatus 110 may be disposed side-by-side on the top surface 620 of the water recreation device 630 aft of the one or more handles 640 to support simultaneous engagement by a rider in various bow-facing riding positions, as discussed in greater detail below.

Figure 7:
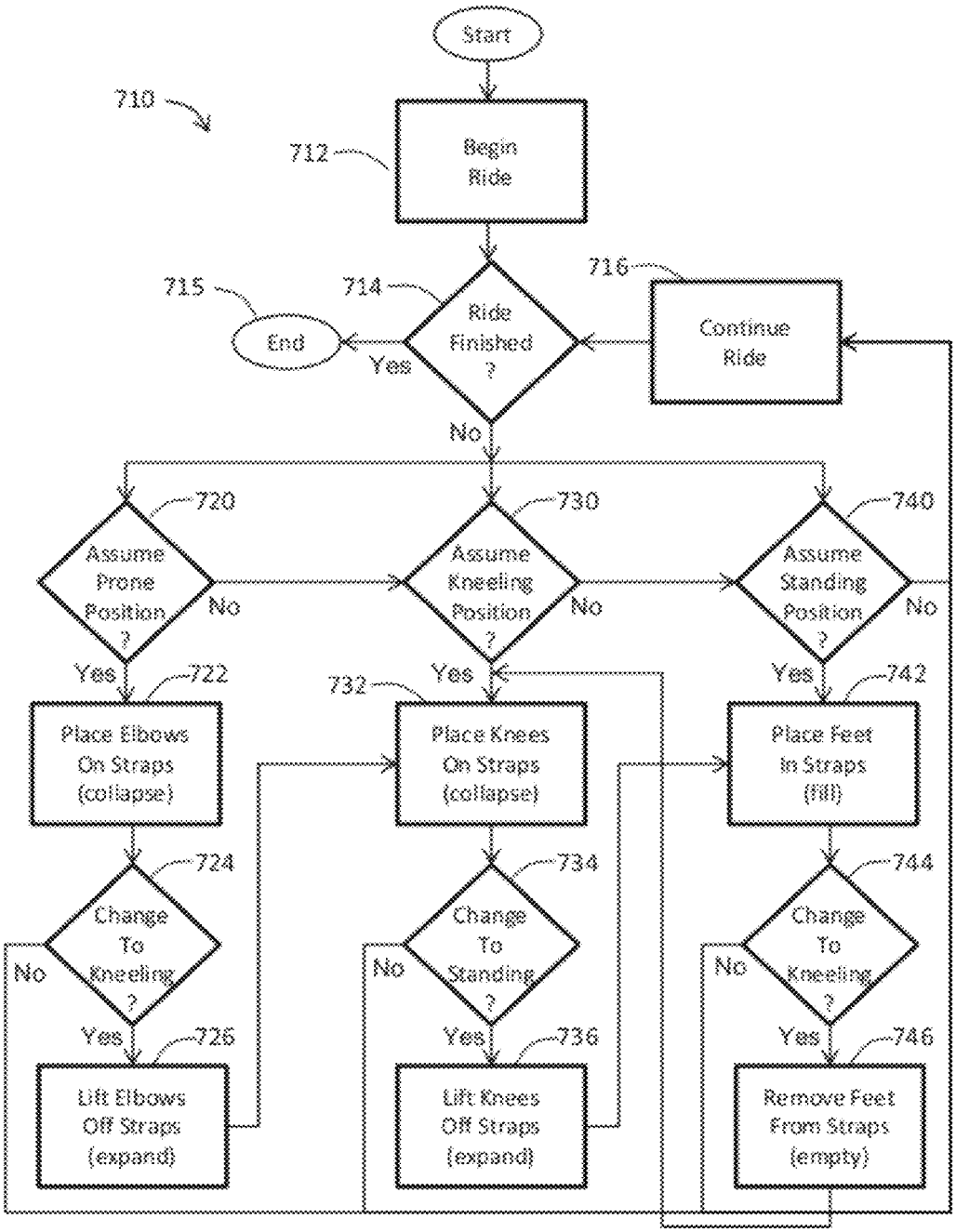
FIG. 7 is a flowchart illustrating various methods of using a multifunction engagement apparatus to transition between prone, kneeling, and standing positions by a rider of a water recreation device according to an alternative embodiment of the invention.

Referring now additionally to flow chart 710 illustrated in FIG. 7, a method aspect of the present invention is now described in greater detail. In the present method, a rider of a water recreation device 630 may advantageously collapse and uncollapse a multifunction engagement apparatus 110 to support a rider's transitions between prone, kneeling, and/or standing positions while riding a device. Those skilled in the art will appreciate that the simplicity of this flowchart 710 is meant to describe the various ways that a rider may advantageously use the multifunction engagement apparatus according to embodiments of the present invention, and will also appreciate that the present invention readily contemplates moving between the various positions that will be described below. Therefore, the description of the various ways in which a rider may use the multifunction engagement apparatus according to the present invention is not meant to be limiting in any way. Instead, it is contemplated that a skilled rider may use the multifunction engagement apparatus according to embodiments of the present invention in many other ways than those which are described herein, all of which are meant to be incorporated into the present invention.

The method starts at Block 712 where both hands of the rider may be assumed to grasp one or more handles 640 of the water recreation device 630 as a ride begins. Unless a rider determines a ride is finished at Block 714, a rider may choose to assume a prone position (Block 720), a kneeling position (Block 730), or a standing position (Block 740) to start a ride.

Figure 8A:
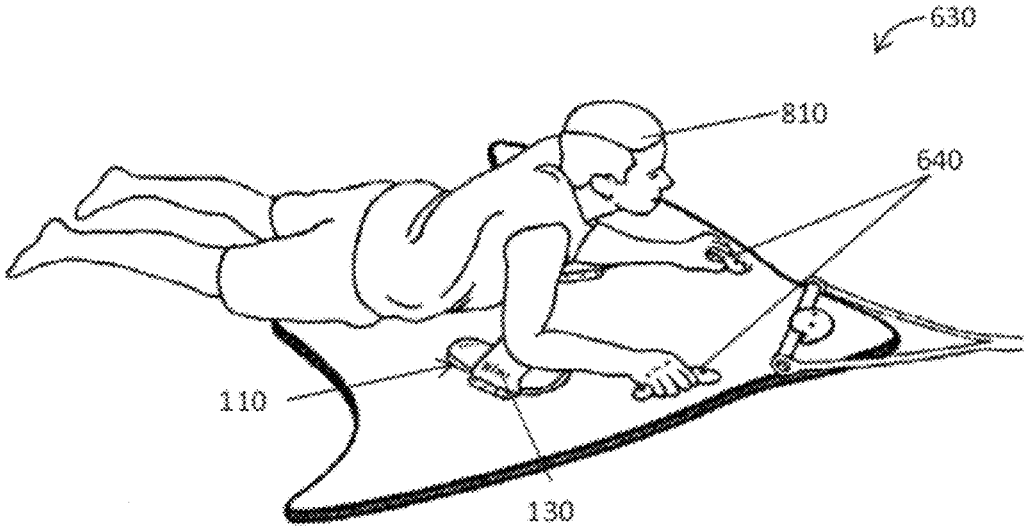
FIG. 8A is a perspective view of a rider in a first position while riding the exemplary water recreation device illustrated in FIG. 6.

Referring additionally to FIG. 8A, a rider 810 who elects to ride in a prone position (Block 720) may place an elbow on each multifunction strap 130 while simultaneously grasping one or more handles 640 that may be mounted to the water recreation device 630 (Block 722). Downward pressure from the weight of a rider's body may collapse each multifunction strap 130 to its substantially flattened configuration in relation to the top surface 620 of the riding board 630. A rider may choose to maintain this prone position for some duration of a ride (Block 716). Alternatively, a rider may elect to change to a kneeling position (Block 724) atop the water recreation device 630. To accomplish this position change, a rider may first lift his elbows off of the multifunction straps 130, allowing the elastic properties of the straps 130 to cause them to reestablish an uncollapsed state (Block 726).

Figure 8B:
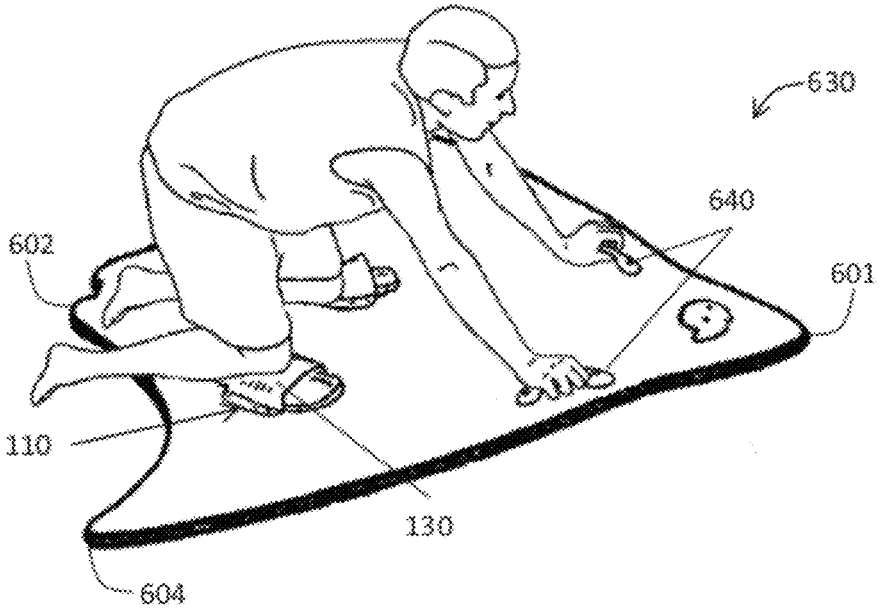
FIG. 8B is a perspective view of a rider in a second position while riding the exemplary water recreation device illustrated in FIG. 6.

A rider who chooses to start a ride from a kneeling position (Block 730) or, alternatively, to change from a prone position to a kneeling position (Block 724) after lifting his elbows off of the multifunction straps (Block 726), may place both knees on the uncollapsed multifunction straps 130 (Block 732) while simultaneously grasping one or more handles 640 that may be mounted to the water recreation device 630, as illustrated in the diagram at FIG. 8B. Downward pressure from the weight of a rider's body may collapse each multifunction strap 130 to its substantially flattened configuration in relation to the top surface 620 of the riding board 630. A rider may choose to maintain this kneeling position for some duration of a ride (Block 716). Alternatively, a rider may elect to change to a standing position (Block 734) atop the water recreation device 630. To accomplish this position change, a rider may first lift his knees off of the multifunction straps 130, allowing the elastic properties of the straps 130 to cause them to reestablish an uncollapsed state (Block 736).

Figure 8C:
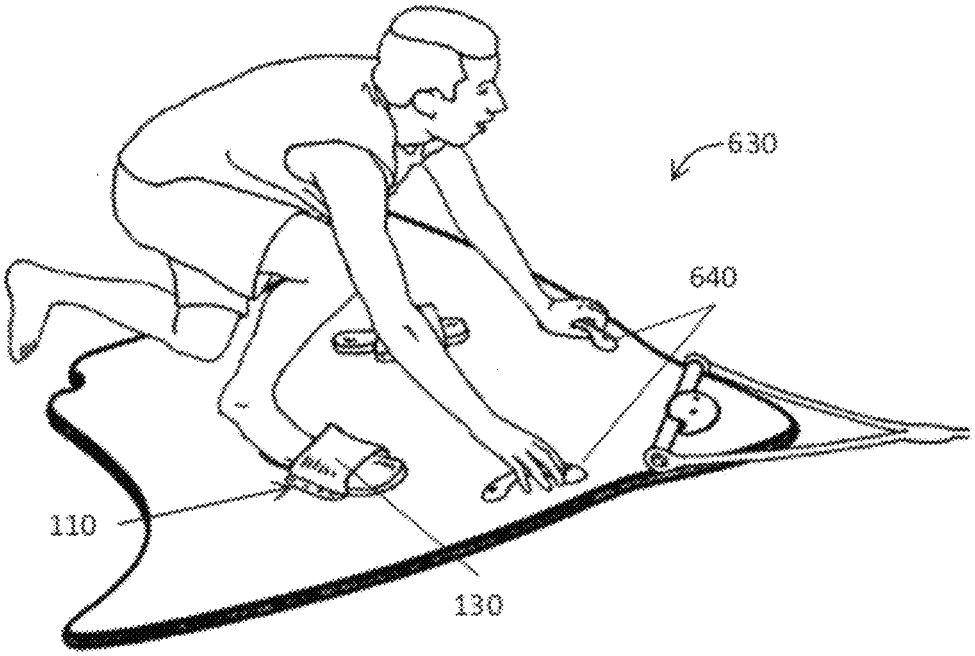
FIG. 8C is a perspective view of a rider in a third position while riding the exemplary water recreation device illustrated in FIG. 6.
Figure 8D:
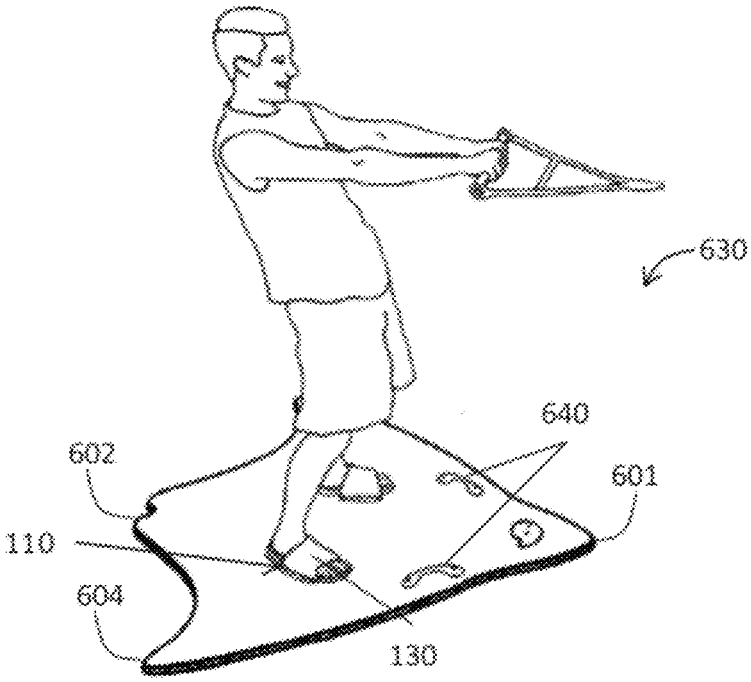
FIG. 8D is a perspective view of a rider in a fourth position while riding the exemplary water recreation device illustrated in FIG. 6.

A rider who chooses to start a ride from a standing position (Block 740) or, alternatively, to change from a kneeling position to a standing position (Block 734) after lifting his knees off of the multifunction straps (Block 736), may move each foot into an uncollapsed multifunction strap 130 (Block 742) while simultaneously grasping one or more handles 640 that may be mounted to the water recreation device 630, as illustrated in the diagram at FIG. 8C. A rider may conduct a ride from a crouched standing position by continuing to grasp the one or more handles 640, or may take up a tow bar or similar support with his hands while assuming a full standing position, as illustrated in the diagram at FIG. 8D. A rider may choose to maintain his chosen standing position for some duration of a ride (Block 716). Alternatively, a rider may elect to change to a kneeling position (Block 744) atop the water recreation device 630. To accomplish this position change, a rider may first remove his feet from the multifunction straps 130 (Block 746) and then may place both knees on the uncollapsed multifunction straps 130 (Block 746) while continuing to grasp the previously selected hand support (e.g., one or more handles 640, tow bar).

At some point during a ride (Block 716), a rider may determine whether or not he is finished with the ride. If it is determined at Block 714 that the rider has completed the ride, then the method is ended at Block 715.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A water recreation device adapted for use by a rider in prone, kneeling, or standing positions, comprising:

a riding board having a top surface, a bottom surface, a bow, a stern, a port, a starboard; and a pair of handles disposed and attached to the top surface of the riding board aft of the bow, one handle each disposed on opposite sides of a bow to stern extending center line of said top surface, and a rearwardly oriented hook for receiving and retaining a separate tow strap handle;

a first multi-function engagement apparatus and a second multi-function engagement apparatus disposed side-by-side on the top surface of the riding board aft of the pair of handles, the first and second multi-function engagement apparatuses each comprising:

a foot pad disposed substantially flatly on the top surface of the riding board, and a multifunction elastomeric strap being moveable between an uncollapsed position and a collapsed position, wherein the uncollapsed position is defined as the multifunction strap being positioned to create a foot opening so that the multifunction strap has a generally arcuate shape projecting from a first end thereof to a second opposing end thereof upwardly in relation to the top surface of the riding board and a top surface of the foot pad, and wherein the collapsed position is defined as the multifunction strap being positioned on said top surface to create a contact cushion adapted to receive an elbow or knee of said rider in a respective prone or kneeling position and provide cushioned support for said elbow or knee in relation to said top surface of said riding board when said rider simultaneously engages said pair of handles, one in each hand of said rider, and said multifunction strap with either said elbow or knee so that the multifunction strap has a slightly concave shape in relation to the top surface of the riding board and the top surface of the foot pad; wherein the pair of handles and the first and second engagement apparatuses are configured for simultaneous engagement by said rider, one of said pair of handles in each hand respectively of said rider and a foot in each of said engagement apparatus respectively, to position the rider in a crouching stance facing the bow of the riding board, with said tow strap handle separately engaged in said rearwardly oriented hook.

2. A water recreation device according to claim 1 wherein the foot pad is fixedly attached to the top surface of the riding board using one or more fasteners selected from the group consisting of adhesives, screws, and nuts and bolts.

3. A water recreation device according to claim 1 wherein the foot pad has an outer peripheral portion that has an arcuate shape.

4. A water recreation device according to claim 1 wherein the multifunction strap comprises a substantially smooth inner cover coupled with a substantially smooth outer cover.

5. A water recreation device according to claim 4 wherein the multifunction strap comprises at least one layer of padding between the smooth inner cover and the smooth outer cover.

6. A water recreation device according to claim 4 wherein the multifunction strap comprises a lace system between the smooth inner cover and the smooth outer cover.

7. A water recreation device according to claim 6 wherein the multifunction strap comprises a pocket opening positioned between the smooth inner cover and the smooth outer cover to create a passageway to the lace system.

8. A water recreation device according to claim 6 wherein the smooth outer cover is releasable from at least one of the first and second ends of the multifunction strap so as to selectively cover or expose the lace system.

9. A water recreation device according to claim 1 wherein each of the first and second ends of the multifunction strap is fixedly attached to at least one of the top surface of the riding board and to the foot pad using fasteners selected from the group consisting of adhesives, screws, and nuts and bolts.

10. A water recreation device according to claim 1 further comprising a receiving groove being fixedly attached to at least one of the top surface of the riding board and to the foot pad; and wherein the receiving groove is adapted to receive at least one of the first and second ends of the multifunction strap.

11. A water recreation device according to claim 1 wherein at least one of the first and second ends of the multifunction strap is releasably attached to at least one of the top surface of the riding board and the foot pad using a hook-and-loop fastener.

12. An engagement apparatus for use by a rider using a water recreation device, said water recreation device comprising a tow behind board having a pair of handles attached on an upper surface thereof aft of a bow of said water recreation device and where each one of said handles is mounted on opposed sides of a bow to stern extending center line of said upper surface, and adapted for use in either prone, kneeling, or standing positions by said rider, comprising:

a foot pad being substantially flat and having a top surface and a bottom surface; and a multifunction elastomeric strap being moveable between an uncollapsed position and a collapsed position; wherein the uncollapsed position is defined as the multifunction strap being positioned to create a foot opening so that the multifunction strap has a generally arcuate shape projecting from a first end thereof to a second opposing end thereof outwardly in relation to the top surface of the foot pad; wherein the collapsed position is defined as the multifunction strap being positioned in relation to said pair of handles, such that when said rider simultaneously grasps said pair of handles with one in each hand of said rider, said top surface of said footpad is a contact cushion adapted to receive an elbow or knee of said rider in a respective prone or kneeling position and provide cushioned support for said elbow or knee in relation to said top surface of said riding board so that the multifunction strap has a slightly concave shape in relation to the top surface of the foot pad; wherein the foot pad has an outer peripheral portion that has an arcuate shape; wherein each of the first and second ends of the multifunction strap is fixedly attached to at least one of the foot pad and to a riding board of a water recreation device.

13. An engagement apparatus according to claim 12 wherein the multifunction strap comprises a substantially smooth inner cover coupled with a substantially smooth outer cover.

14. An engagement apparatus according to claim 13 wherein the multifunction strap comprises at least one layer of padding between the smooth inner cover and the smooth outer cover.

15. An engagement apparatus according to claim 13 wherein the multifunction strap comprises a lace system between the smooth inner cover and the smooth outer cover.

16. An engagement apparatus according to claim 15 wherein the multifunction strap comprises a pocket opening positioned between the smooth inner cover and the smooth outer cover to create a passageway to the lace system.

17. An engagement apparatus according to claim 15 wherein the smooth outer cover is releasable from at least one of the first and second ends of the multifunction strap so as to selectively cover or expose the lace system.

18. An engagement apparatus according to claim 12 further comprising a receiving groove being fixedly attached to the foot pad; and wherein the receiving groove is adapted to receive at least one of the first and second ends of the multifunction strap.

19. An engagement apparatus according to claim 12 wherein at least one of the first and second ends of the multifunction strap is releasably attached to the foot pad using a hook-and-loop fastener.

20. A method of riding a water placed tow behind water riding board device, said device adapted for use by a rider in successive prone, kneeling, or crouching positions, comprising the steps of:

mounting said water placed riding board, said board having a top surface, a bottom surface, a bow, a stern, a port, a starboard; and a pair of handles disposed on and attached to the top surface of the riding board aft of the bow, one handle each disposed on opposite sides of a bow to stern extending center line of said top surface, and a rearwardly oriented tow hook for receiving and retaining a separate tow strap handle, in a prone position and separately grasping one of each of said pair of handles;

engaging a tow strap handle to said rearwardly oriented hook;

resting an outward aspect of a riders elbow on each of a pair of multi-function engagement apparatus, said pair of apparatus comprising a first and a second multi-function engagement apparatus disposed side-by-side on the top surface of the riding board aft of said pair of handles, the first and second multi-function engagement apparatuses each comprising a pad disposed substantially flatly on the top surface of the riding board, and a multifunction elastomeric strap being moveable between an uncollapsed position and a collapsed position, wherein the uncollapsed position is defined as the multifunction strap being positioned to create a foot opening so that the multifunction strap has a generally arcuate shape projecting from a first end thereof to a second opposing end thereof upwardly in relation to the top surface of the riding board and a top surface of the pad, and wherein the collapsed position is defined as the multifunction strap being positioned on said top surface to create a contact cushion adapted to receive said outward aspect of said elbow or a knee of said rider, in respective prone or kneeling positions, and provide cushioned support for said elbow or knee in relation to said top surface of said riding board when said rider simultaneously engages said pair of handles, one in each hand of said rider, and said multifunction strap with either said elbow or knee so that the multifunction strap has a slightly concave shape in relation to the top surface of the riding board and the top surface of the pad;

initiating a tow of said board across said water while remaining in a prone position atop said board;

maneuvering from a prone to a kneeling position atop said board while still grasping said pair of handles and engaging each of said multi-function apparatus with a respective knee to ride said board in a kneeling position, and, repositioning feet of said rider to engage each of said multi-function apparatus in an uncollapsed position, wherein each one of said pair of handles is grasped in each hand respectively of said rider and a foot in each of said engagement apparatus respectively, to position the rider in a crouching stance facing the bow of the riding board, with said tow strap handle separately engaged in said rearwardly oriented hook.

* * * * *